United States Patent [19]

Littwin, Sr.

[11] 4,121,865

[45] Oct. 24, 1978

[54] PICKUP METHOD AND APPARATUS

[76] Inventor: Robert L. Littwin, Sr., 1200 Granville Ave., Park Ridge, Ill. 60068

[21] Appl. No.: 748,816

[22] Filed: Dec. 9, 1976

[51] Int. Cl.[2] ..... B66C 1/00

[52] U.S. Cl. ..... 294/2; 294/64 R; 214/8.5 D; 294/65.5

[58] Field of Search ..... 294/65, 65.5, 64, 64 A, 294/64 B, 2; 214/14, 8.5 D, 650 SG; 271/18.1

[56] References Cited

U.S. PATENT DOCUMENTS

| | | | |
|---|---|---|---|
| 3,159,418 | 12/1964 | Hansen | 294/64 R |
| 3,409,149 | 11/1968 | Graux | 214/8.5 D |
| 3,517,835 | 6/1970 | Temple | 214/8.5 D |
| 3,795,334 | 3/1974 | Ishidu et al. | 294/65.5 |
| 3,858,926 | 1/1975 | Ottenhues | 294/64 |

*Primary Examiner*—James B. Marbert

*Attorney, Agent, or Firm*—Clarence A. O'Brien; Harvey B. Jacobson

[57] ABSTRACT

A multipurpose lifting device with variable holding power to both electromagnet and vacuum cup pickup structure to eliminate any physical damage either external or internal to the workpiece by distortion, with a permanent magnet feature to be used as a standby safety, or used in conjunction with the electromagnet and vacuum cup structure to triple the lifting power per square inch of surface area when attached to the workpiece. This structure is a perfected device for picking up a plate or sheet of ferrous or non-ferrous material individually from a stack of same. The power to the unit can be variably controlled to eliminate distortion to the sheet or plate for transport with an independent self-regulating permanent magnet safety for ferrous metal. If all power to the apparatus fails, it will automatically retain the ferrous metal sheet indefinitely until it can be brought to rest in a safe position.

15 Claims, 16 Drawing Figures

PICKUP METHOD AND APPARATUS

BACKGROUND OF THE INVENTION

1. Field of the Invention

This invention relates generally to devices for picking up a plate or sheet of ferrous material individually from a stack of same, with a self regulating permanent magnet safety which is activated when all power to the device is withdrawn.

2. Description of the Prior Art

A common problem with known pickup devices of the vacuum and electromagnet type is that there are no built in automatic safety devices. The vacuum cup often will not seat properly to allow the cup to obtain a positive and quick vacuum lock. This is usually the case when two or more cups are used on the same device and especially on irregular surfaces.

Known vacuum cup and electromagnet combination devices do not offer variable holding power in either or both structures to allow a positive removal of one piece of ferrous metal at a time from a stack either by manual or automatic regulation. Regulated power as well as cushioning is needed to prevent distortion of the workpiece in ferrous or non-ferrous materials, especially in the transport of thin material in sizable sheet form with no means of underlayment or support.

Also, no known device has an automatic non-powered safety stand-by for ferrous materials which can retain the work pieces in the case of a complete power failure and not allow the workpiece to fall on working people in the area. The lack of a safety stand-by creates a very serious and dangerous situation to all concerned in todays' industry.

Known prior art patents which may be pertinent to this invention are as follows:

U.S. Pat. No. 1,181,112 J. P. C. Charlebois May 2, 1916,

U.S. Pat. No. 1,207,662 R. B. & H. S. Thomas et al Dec. 5, 1916,

U.S. Pat. No. 2,474,141 R. T. Chatterton June 21, 1949,

U.S. Pat. No. 3,159,418 J. J. Hanson Dec. 1, 1964,

U.S. Pat. No. 3,409,149 P. Graux Nov. 5, 1968,

U.S. Pat. No. 3,517,835 H. E. Temple June 30, 1970.

None of these known prior art devices offers the new and unique features of the invention disclosed herein.

SUMMARY OF THE INVENTION

An object of the present invention is to provide a magnetically attractable holding device employing magnetic lines of flux of both the permanent type as well as the variable electromagnet type together with a cushioning member which also doubles as a vacuum holding structure with a positive cup seal for quick vacuum lock.

Another object of the present invention is to provide a multipurpose lifting device having three sources of lifting and holding power, two of which are variable and operable independently of each other, or together and simultaneously with the third, in order to increase the overall effectiveness of the lifting device.

A further object of this invention is to provide a lifting device having a permanent magnet structure for supplying permanent lines of magnetic flux, electromagnet structure for providing variable electromagnetic lines of flux through the electromagnet structure, and a vacuum suction type lifting and holding structure controllable by various means for varying the degree of vacuum applied thereto.

A still further object of this invention is a permanent magnet type safety device for ferrous materials that automatically comes into action when all other power to the unit is disrupted. The permanent magnet also acts to pull down the vacuum cup for a complete seal before vacuum is applied and before it is retracted to a fail-safe position.

One of the important purposes of this invention is to lift one single sheet or piece of ferrous material at a time from a pile or stack of such sheets. The method used is as follows: the vacuum cup portion of the overall lifting and hoisting device lifts and separates the top piece from a pile thereof, and then once the individual piece is removed from the presence of the metal of the remaining stack, the electromagnet portion of the lifting device is energized, thus securely holding the individual piece. With both the vacuum and magnetic holding force being present simultaneously, and the permanent magnet in a fail-safe position, the fail-safe movement of the piece to another station may be accomplished. This greatly increases the overall safety and protection for anyone that may be around the operation.

It has been discovered that a single piece of ferrous material cannot constantly and positively be removed from a stack with a non-variable electromagnet device, but with this new and improved combination lifting device, individual pieces can consistently be removed and transported safely to another desired point.

Also by providing permanent magnet particle containing structure in combination with the vacuum and electromagnet structures, the overall reliability and effectiveness of the entire lifting device is greatly increased.

Another important feature of this device is in the cushioning action of the flexible material which is used for the suction cup of the vacuum portion of the device. That is, when applying the magnetic attraction capabilities of the device, as the lifter approaches the material to be lifted, the edges of the vacuum structure contact the material first and absorb any shock or tendency of the device to bang into the material, or scratch or damage the material. Thus, even though the magnetic lifting structure may be employed without using vacuum, the suction holding structure effectively acts as a shock absorber and cushion and thereby plays an important part in addition to the holding action supplied thereby.

These, together with other objects and advantages which will become subsequently apparent, reside in the details of construction and operation as more fully hereinafter described and claimed, reference being made to the accompanying drawings forming a part hereof, wherein like numerals refer to like parts throughout.

DESCRIPTION OF THE PREFERRED EMBODIMENT

Figure 1:
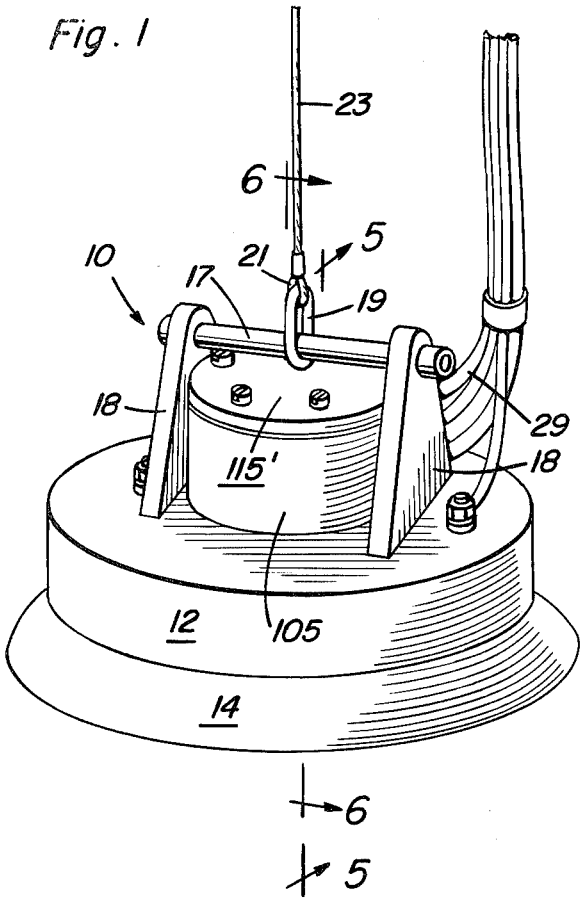
FIG. 1 is a perspective view of the overall lifting and hoisting device of this invention.
Figure 2:
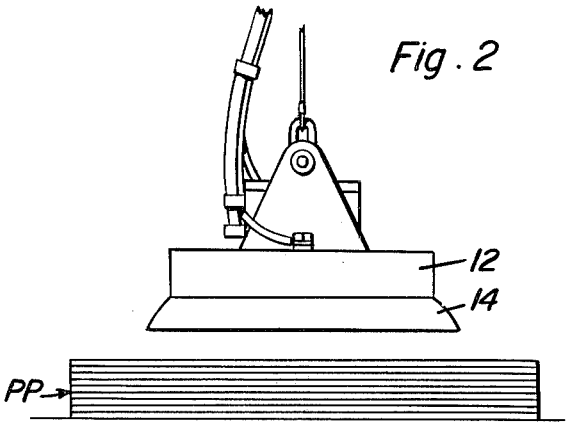
FIG. 2 is a side view of the device just prior to engagement with the top plate of a stack of ferrous sheets.
Figure 3:
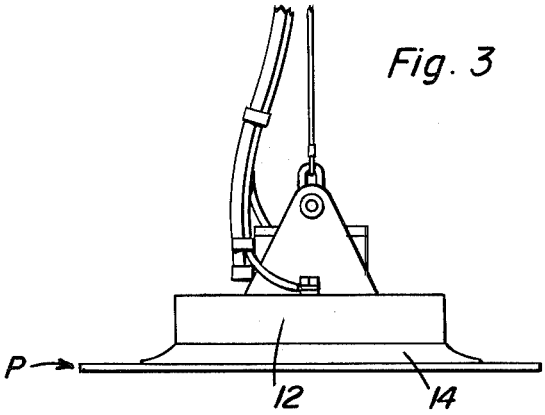
FIG. 3 is a side view showing the device after engagement with the top sheet as in FIG. 2 and in the process of transporting same.
Figure 4:
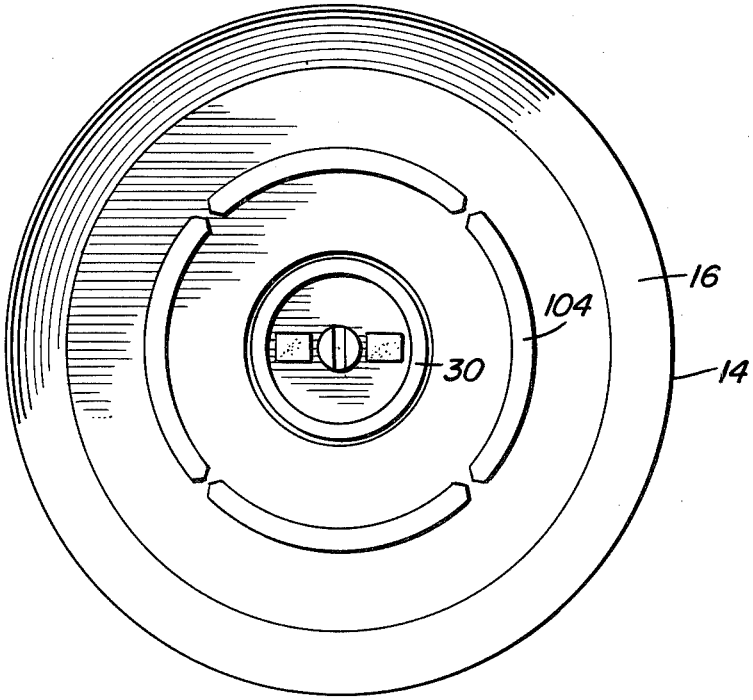
FIG. 4 is a plan view from the bottom of the device of FIG. 1.

Referring to FIG. 1 of the drawings, reference numeral 10 indicates in general the overall multipurpose lifting and transporting device of this invention. The main structural member 12 has depending therefrom a resilient flange member 14 of flexible rubber-like material. This flange portion 14 functions in a dual purpose manner. First, it acts as a resilient cushion when the overall lifting device structure 12 is positioned and lowered into contact with material to be lifted and transported, such as a sheet of ferrous material from stack PP as shown in FIG. 2. The flange portion 14 also functions as a vacuum cup or suction cup type holding device in conjunction with an appropriate vacuum or suction line 29 which also acts to retain a permanent magnet 30 in the up position (FIG. 6) by a vacuum holding action on a cylinder head 101. Extending from the top of the main body member 12 are spaced flanges 18 for holding a pin 17 and an attachment link 19 for the cable 23 with attachment, loop structure 21 attached thereto.

Looking at FIGS. 5 and 6, the component parts of the overall lifting structure will be described in detail. Inside the primary body member 12 are mounted the following components; first a permanent magnet 30 is provided for supplying magnetic lines of flux equal to those of the electromagnet or equal to the safety rating of the vacuum cup. Secondly, the electromagnet core portion of the device 40 is surrounded by an electromagnet coil 42 appropriately connected by a lead 44 to a positive terminal 46 and by a lead 45 to a negative terminal 47. These terminals are appropriately connected by electric cables 48, 49 to the positive and negative terminals of a control device, not shown, for varying the amount of current supplied to the coil. By varying the amount of current supplied, the electromagnet will change the amount of electromagnetic lines of flux produced which variation may be measured by a variation in magnetic gauss level. This may be appropriately calculated and the control device calibrated so that the operator of the device may set the control device for whatever given range of output and holding power is desired, and in this manner be able to repeatedly achieve the same amount of holding power from the electromagnet portion of the device in a predetermined and preset manner. This would also enable the operator to pickup one sheet at a time from the pile with the electromagnet portion if the vacuum supply for any reason were not available.

Assembled on top of the main body 12 in FIGS. 1-6 is an air-vacuum operated cylinder 105. The purpose of cylinder 105 is to actuate the permanent magnet 30 in conjunction with the components in the main body 12 to move it to preselected positions.

Figure 5:
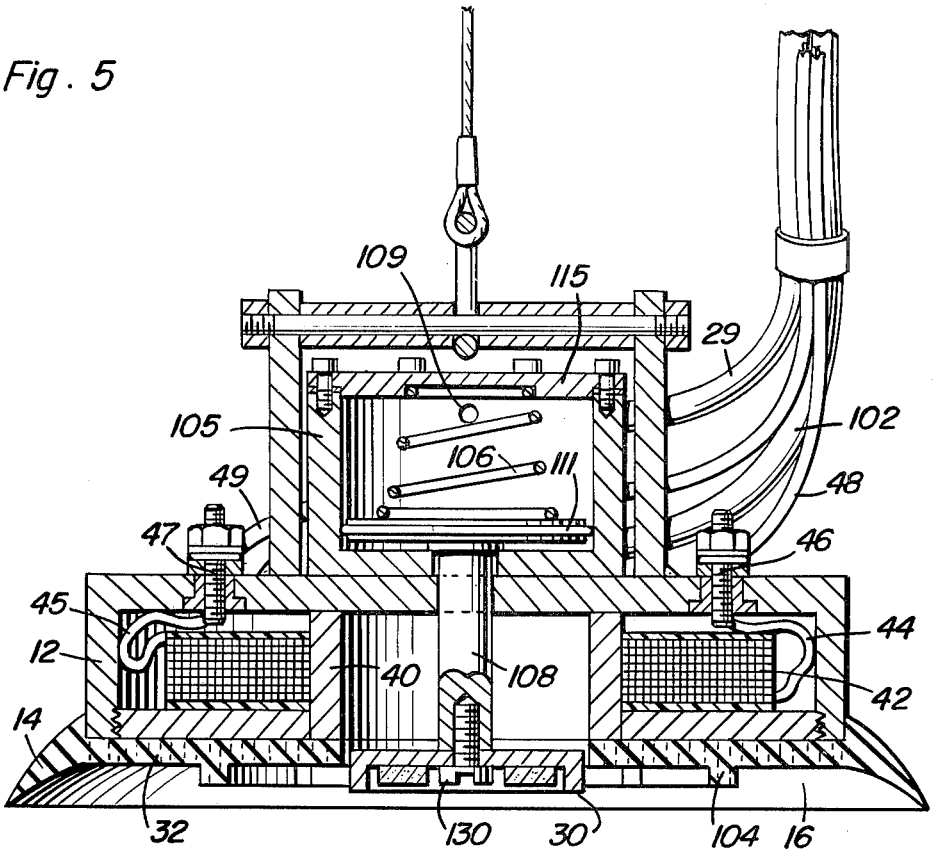
FIG. 5 is a side elevational view, partly in cross section, taken generally along line 5—5 of FIG. 1.
Figure 6:
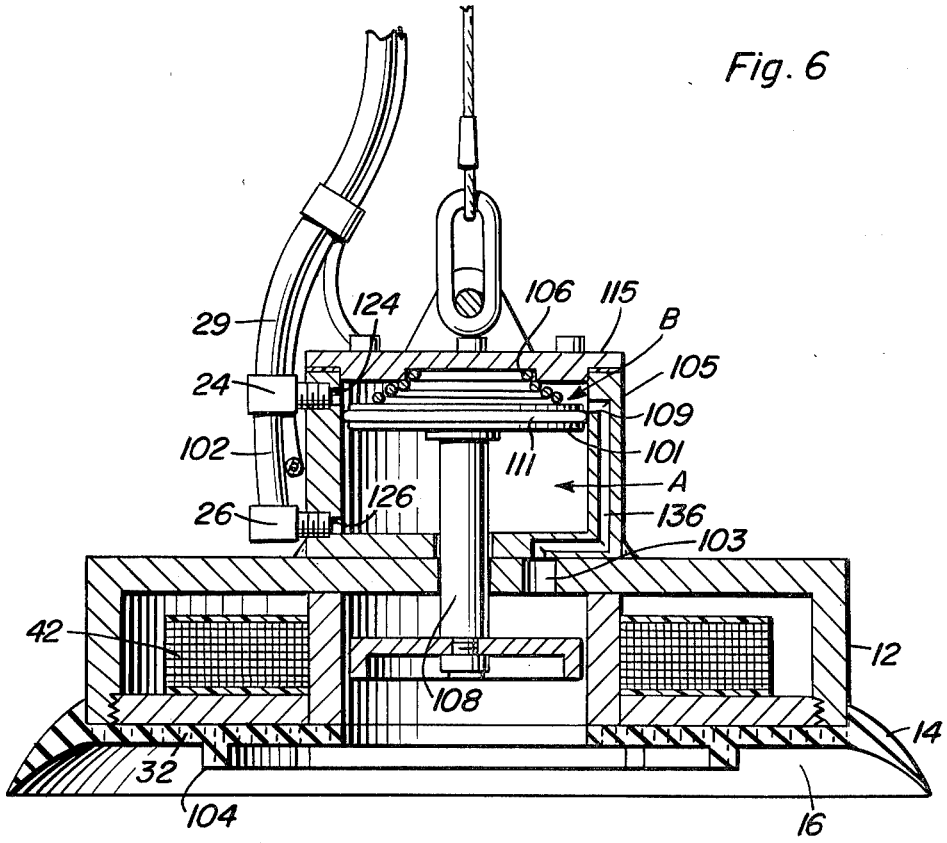
FIG. 6 is a side elevational view, partly in cross section, taken generally along line 6—6 of FIG. 1.

The inner components of the overall structure of this embodiment can best be seen in FIGS. 5 and 6. The permanent magnet structure 30 is mounted by a large head bolt 130 on one end of a piston 108 which is in turn connected to a cylindrical piston member 101 having a resilient piston ring member 111 provided thereon. A biased spring 106 is provided between the upper side of piston 101 and the removable cylinder cap 115. This resilient spring 106 normally biases the piston 101 and connecting rod 108 with permanent magnet 30 mounted thereon in the downward position as in FIG. 5. Also, small permanent magnet particles 32 may be embedded in the suction cup member 16 to provide a residual magnetic flux field.

The cylinder 105 is provided with apertures 124 and 126 which are in turn provided with couplings 24 and 26 which are connected to vacuum hose 29 and pressure hose 102. The pressure hose 102 may be connected to a source of compressed air or other source of pressure. Appropriate air valves and controls for these two hoses, not shown, may be mounted adjacent the control panel for the electromagnet coil 42 and connecting cables 48 and 49. With these controls the operator may apply suction through line 29 for effectively increasing the vacuum of the suction cup portion of the device, or may apply pressure through hose 102 to further effect operation of the device as described in greater detail below. Another aperture 109 is connected by 136 to aperture 103 provided in the top portion of the body 12. These ports permit a flow of vacuum or air under pressure between the ports 124 and 126 depending upon the position of the piston 101 within the cylinder 105.

The device as shown in these Figures and described above can be used in a non-marring or non-distorting manner either singly or in various combinations as follows:

I - VACUUM CUP ALONE

The device as shown in the position of FIG. 5 may be operated in the following manner. The operator will by means of appropriate hoist, boom and crane mechanism lower the cable 23 and the device 12 into close proximity to the stack of metal plates PP as shown in FIG. 2. As the resilient flange portion 14 of the suction cup 16 engages with the topmost sheet, the cushioning effect of the flange will take place. The vacuum line 29 then may be energized to hold the top plate tightly against the suction cup projections 104 which are provided on the inner side thereof. The permanent magnet structure 30 being initially in the spring biased down position will attract the top plate P if the plates are of ferrous material, or rest buoyantly on top of said plate if the plates are of non-ferrous material. However, the main holding action will be effected by the vacuum cup and the vacuum applied through vacuum line 29.

II - PERMANENT MAGNET ALONE

When the device as seen in FIG. 5 is lowered into the position for pickup as in FIG. 2, and if no vacuum or electricity is applied to the device, the permanent magnet 30 in the down position will attach to a ferrous sheet and cause the flange 14 to expand and permit a vacuum cup action to occur even though the vacuum line 29 is not energized, but is closed to the atmosphere.

III - ELECTROMAGNETIC DEVICE

The device again is lowered as in FIG. 2 and the same action initially occurs as in II above but with the combination of electromagnetic flux lines due to energization of the electromagnet coil 42 by full or variable current through the cables 48 and 49 to terminals 46 and 47 and leads 44 and 45 to the coil 42.

IV - ALL COMPONENTS WITH SAFETY FEATURE

The device is lowered as shown in FIG. 2 into contact position with all the component units being in place as in FIG. 5. Upon the initial contact of the device on the top sheets of the pile PP, the flange portion 14 of the suction cup 16 cushions the impact of the device, and the permanent magnet 30 being in the down position, quickly attracts and locks onto the top ferrous sheet P, in turn expanding the flange lips 14 until the suction cup has a firm grip on the plate and the extrusions 104 rest solidly against the plate. Air pressure from a compressed air source or the like is then applied through hose 102 to coupling 26 and port 126 in order to force piston 101 upwardly in the cylinder 105 toward the cylinder head 115; this simultaneously with vacuum being applied through hose 29 at full or variable capacity as determined by the operator of the device. The bias of the spring 106 is strong enough that vacuum alone applied through hose 29 and through port 124 will not lift the piston 101 against the spring. When pressure is simultaneously applied through hose 102 and 126, the combination of the two will move the cylinder 101 upwardly as seen in FIG. 6. Sensing means (not shown) may be provided with the cylinder 105 to automatically cut off the air pressure supplied through hose 102 when the piston 101 reaches the position shown in FIG. 6. The vacuum normally is continued to be drawn through the hose 29, coupling 24 and port 124 which is sufficient once the piston head 101 is in the upward position to retain same in this position. This vacuum also continues to be applied through the port 109, connecting passage 136, and apertures 103 to effect the increased suction cup effect already described. At this point, the sheet is moved out of the magnetic range of the remaining sheets in the pile PP and into the position shown in FIG. 3. Now, the electromagnet coil 42 is energized as already described at either full or variable capacity. The sheet P is now in a "fail-safe" condition ready for transporting to a new location.

The fail-safe condition is maintained automatically by the vacuum draw through hose 29 to the cylinder 105 and retains the piston 101 in the position of FIG. 6. The permanent magnet 30 will only be maintained in this up position as long as a required minimum amount of vacuum is in the cup and the cylinder 105. If the vacuum should drop below this predetermined level, the spring 106 will function in a safety effect manner and drive the permanent magnet 30 from the up position of FIG. 6 to the down position of FIG. 5. This will again allow the permanent magnet 30 to make contact with the single sheet P of FIG. 3, securely locking the single sheet against the lips 14 and protrusions 104 of the suction cup 16 with equal holding capacity of either the vacuum cup 16 alone or the electromagnet structure 40–42 alone. If the electromagnet portion 40–42 also fails at the same time that the vacuum in line 29 fails or lowers below the predetermined minimum, suitable warning devices such as lights or audible sound signals, not shown, mounted on the control panel of the operator would warn the operator of such condition and allow him to lower the device while the permanent magnet 30 alone retains the sheet P attached to the device. Once the operator has safely lowered the plate to the ground then the reason for the loss of vacuum as well as loss of electric power may be determined in complete safety.

V - ALL COMPONENTS FOR THREE TIMES POWER LESS SAFETY

The device is lowered into position as in FIG. 2 and as it comes into contact with the top sheet P of the stack PP, the device is cushioned by the flexible flange 14 of the suction cup 16 while the permanent magnet 30 locks the top ferrous sheet and tends to expand the flange lips 14 until the protrusions 104 of the vacuum cup fit tightly against the sheet. Compressed air is not used in this application. However, vacuum is drawn through the hose 29, coupling 24 and port 124 to the interior of cylinder 105. This vacuum also continues through the port 109, connecting channels 136 and 103 in order to vacuum lock the single sheet P to the suction cup 16. The permanent magnet structure 30 remains in holding contact with the single sheet P in this application because the vacuum in the cylinder 105 cannot draw the piston head 101 upwardly without the positive air pressure applied through pressure hose 102 to piston 101 and against the safety spring 106. Preferably, automatic controls effect energization of the electromagnetic structure 40–42 while vacuum is being drawn on hose 29. This automatic switching is not shown but is envisioned in the invention. Because all three lifting components, i.e., the permanent magnet 30, the vacuum cup 16, and the electromagnet structure 40–42 are all of equal lifting capacity, the device when operated in this manner has three times the lifting capacity per square inch of contact area than it has when the components are used individually.

To release all five of the above methods of holding (I-V), the device may be operated as follows:

Looking at FIG. 6, compressed air under suitable high pressure is applied through hose 102, coupling 26, and port 126. In the release function the pressure is maintained longer than as described previously until the pressure builds up within the portion A of the cylinder 105 sufficiently to drive the piston head 101 upwardly into area B of the cylinder 105. In this position, the permanent magnet 30 is in the uppermost position and completely away from the single plate which has been held thereby and the movement of the piston 101 past the port 109 effectively disconnects the vacuum through port 124 to completely disconnect the vacuum being applied to the suction cup 16. Simultaneously with this loss of vacuum, pressure within the portion A of the cylinder passes through the port 109, vent channel 136, and aperture 103 to apply pressure between the inside of the vacuum cup and the top plate surface. Thus, the plate will be positively disengaged by air pressure from all of the attracting portions of the overall device, including the embedded permanent magnet particles 32 in the resilient material of the suction cup itself.

Figure 7:
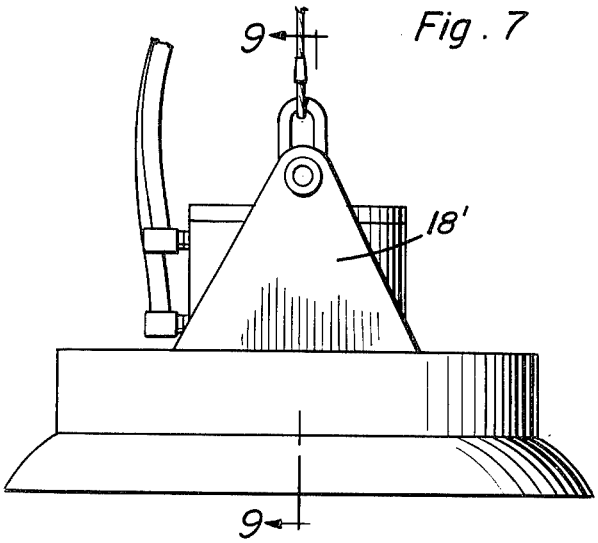
FIG. 7 is a side view of a modified embodiment of the device of this invention.
Figure 8:
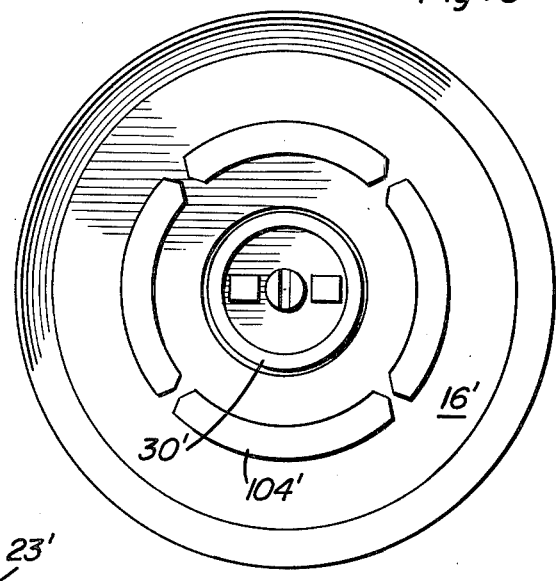
FIG. 8 is a plan view from the bottom of the device of FIG. 7.
Figure 9:
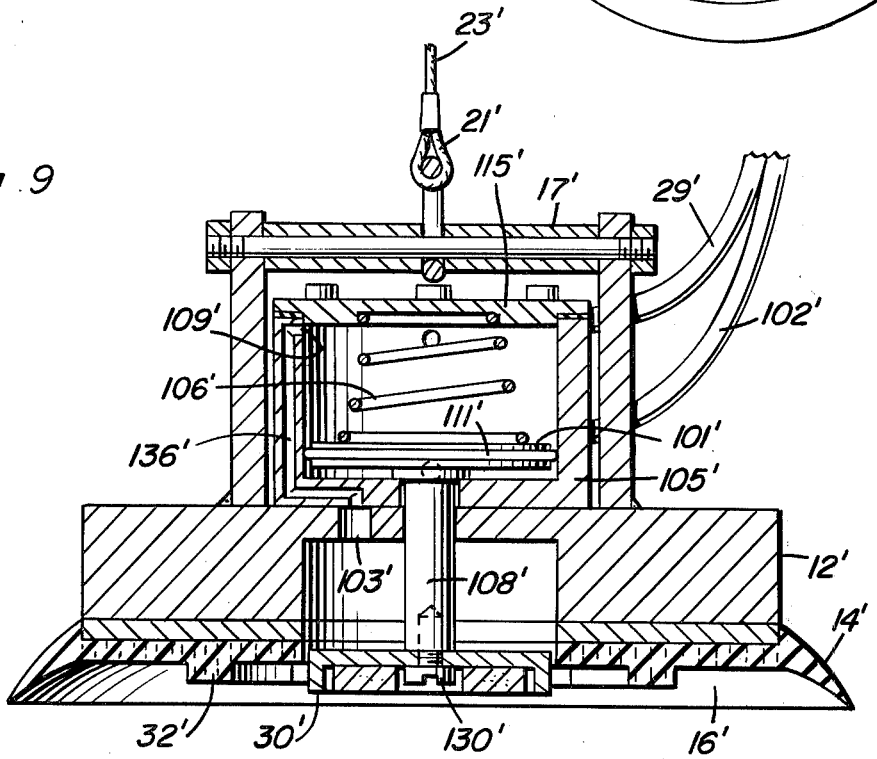
FIG. 9 is a side elevational view, partly in cross section, taken generally along line 9—9 of FIG. 7.

FIGS. 7-9 show another embodiment wherein the electromagnet structure 40-42 has been eliminated and only the permanent magnet structure and vacuum structure is used. Similar reference numerals are used for similar components with a prime added thereafter. The operation of this embodiment is basically similar to that described above, but with the portion applicable to the electromagnetic operation being omitted.

Figure 10:
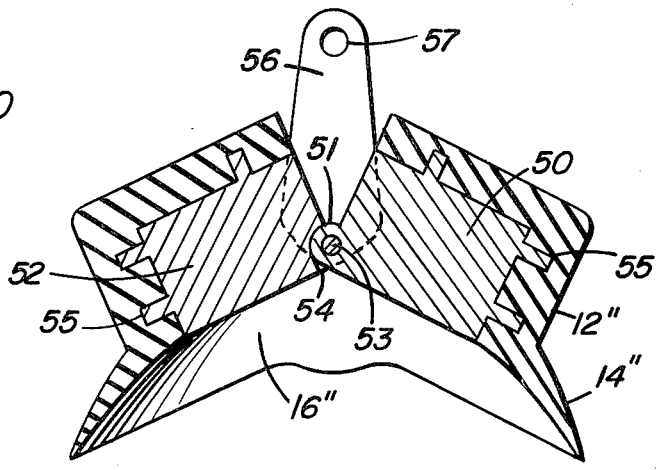
FIG. 10 is another embodiment of the device of this invention.
Figure 11:
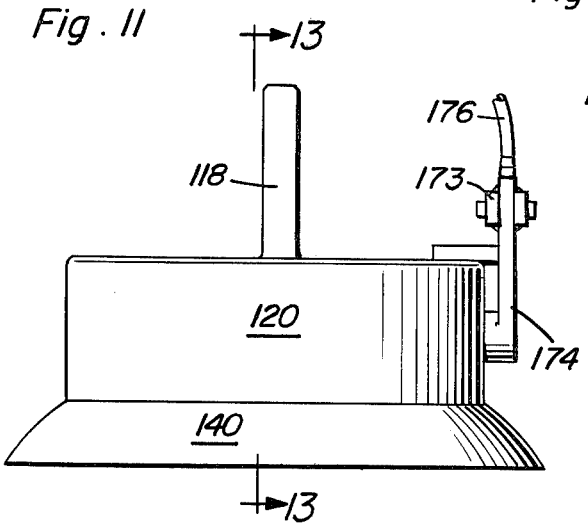
FIG. 11 is a side view of still another embodiment of this invention.
Figure 12:
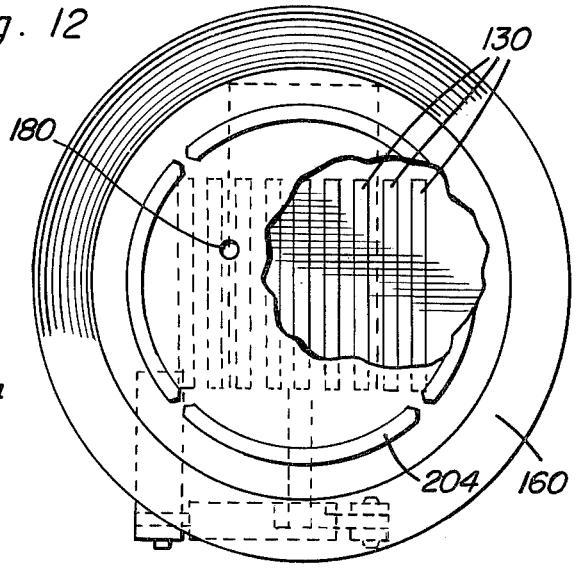
FIG. 12 is a plan view, partly broken away, from the bottom of the device of FIG. 11.
Figure 13:
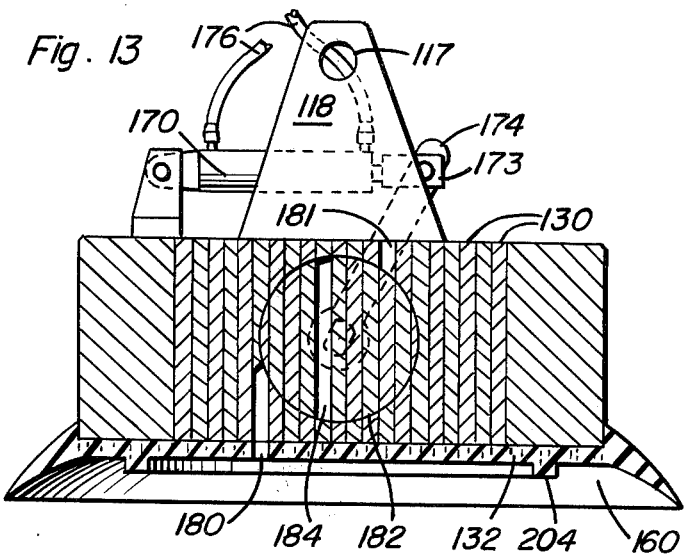
FIG. 13 is a side elevational view, partly in cross section, taken generally along line 13—13 of FIG. 11.
Figure 15:
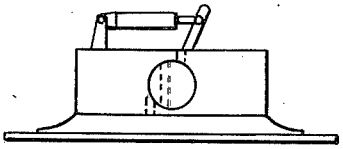
FIG. 15 shows in simplified block form the operation of FIG. 13.
Figure 16:
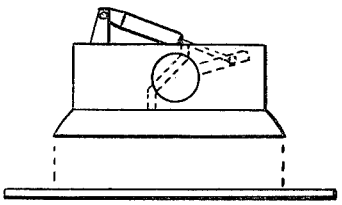
FIG. 16 shows in simplified block form the operation of the device in FIG. 14.
Figure 14:
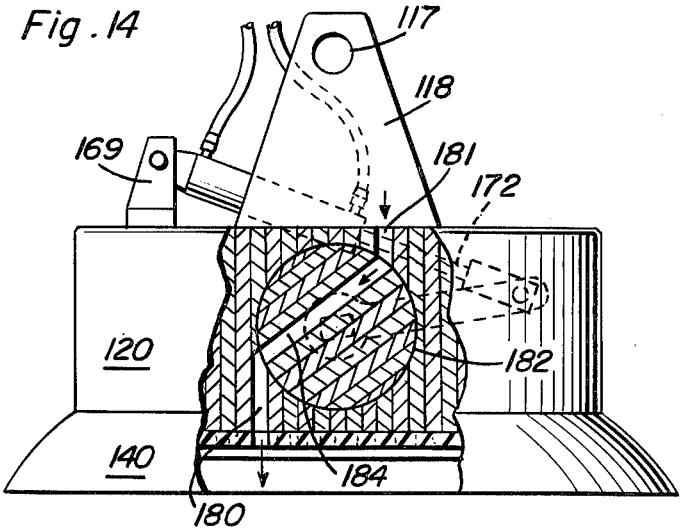
FIG. 14 is a similar view to that of FIG. 13 showing the component units in a different phase of operation of the device.

FIG. 10 shows another embodiment of this invention wherein only permanent magnet structure members 50 and 52 are provided. The two parts are pivotally connected by a projecting portion 51 on the member 50, which extends into a recess 54 in the other member 52. An appropriate hinge pin 53 is provided for the pivot point between the two members. Also, attached by means of this pivot pin 53 are lifting brackets 56 (only one shown) having apertures 57 provided therein for attachment to a lift bolt similar to 17 of the first embodiment. Projections 55 on the permanent magnet members 50 and 52 provide the connecting points to hold the members securely engaged with the main body structure 12".

The operation of this embodiment is by the residual lines of flux as created by the permanent magnet members 50, 52 when the two are together, and additionally by the suction cup effect of the flange portion 14" and the inner surface 16". A mechanical-type lock normally would be provided across the upper portion of the pivoted sections 50, 52 in order to keep the members together in appropriate load and lifting positions and with said lock being disengageable when it is desired to release the plate from the device.

FIGS. 11-16 show still another embodiment of the invention. The main support structure of this embodiment is indicated by reference numeral 120 while the resilient cushioning suction cup flange portion is indicated by reference numeral 140. A single lifting attachment flange 118 with aperture 117 therein is also provided. In the center of the main support structure 120 is mounted a plurality of permanent magnets 130 aligned with the north and south poles vertically as viewed in FIGS. 13 and 14. The central portion of the overall structure is also provided with a rotor pole 182 which may be rotated in turn by means of a connecting arm 174 attached at one side thereof. The lever 174 is attached to outer end 173 of a piston rod mounted within a fluid power cylinder 170. This fluid power cylinder is in turn pivotally mounted on a support flange 169 on the main housing structure. Appropriate connecting hoses 176 attach at each of the ends of the fluid cylinder 170 for actuation of the piston contained therewithin in a conventional manner. Either hydraulic fluid or a pneumatic system may be employed with appropriate control valves being mounted on the operator's control panel. In addition to the variation in magnetic lines of flux from the permanent magnet structure permitted by this arrangement, an aperture 180 connecting with the inside of the vacuum cup structure 160 is also provided in contact or communication with the rotor pole. Another aperture channel 184 is provided through the rotor pole, and on the upper portion of the structure 120 and the upper central magnet structure 130 is provided a communication channel 181. Thus, as perhaps can more clearly be seen in the diagrammatic showing of FIG. 15, when the rotor pole is turned for maximum lines of magnet flux from the permanent magnet, the aperture channel 184 is turned so as to block any source of atmospheric air to the inner portion of the vacuum cup 160. Thus, when the overall device is applied to a single plate P, maximum holding and lifting force will be present. However, when the operator desires to unload the plate or release same from this device, he merely has to actuate the fluid cylinder 170 with piston therein to rotate the rotor pole in a clockwise direction as viewed, which will decrease the permanent magnet lines of flux and also simultaneously permit the flow of atmospheric air through aperture channel 181, channel 184, and channel 180 into the vacuum cup structure. Thus, the holding power of the vacuum cup structure will be completely eliminated, while the holding power of the permanent magnet structure will be substantially diminished. The plate P then will normally drop off or at least can be easily pulled away from the remaining magnetic attraction.

From the above described embodiments, one can readily visualize how effective this multipurpose lifting structure may be in actual practice for safely and economically holding, lifting and transporting sheet material.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A lifting device for sheet material, comprising a vertically suspended body, a suction cup depending from said body having a fixed sealing surface engageable with said sheet material, flexible means for cushioning engagement of the sealing surface with the sheet material and suction chamber means rendered effective in response to said engagement of the sealing surface for holding the sheet material on the body with a predetermined holding force, a permanent magnet, means mounting the permanent magnet in the body for exerting a magnetic holding force on the sheet material while in contact with the sealing surface and movable mechanical means connected to the permanent magnet for rendering the same ineffective in a standby condition by reducing the magnetic holding force applied to the sheet material.

2. The combination of claim 1 including selectively energized, electromagnetic means for exerting an additional magnetic holding force on the sheet material, while in engagement with the sealing surface, substantially equal to said predetermined holding force, at least one of said holding forces being adjustably varied to prevent distortion of the sheet material.

3. The combination of claim 2 wherein the additional magnetic holding force may be applied to the sheet material simultaneously with the holding forces exerted by the suction chamber means and the permanent magnet.

4. The combination of claim 3 wherein said movable mechanical means comprises spring means biasing the permanent magnet to an extended contact position within the suction cup projecting beyond the sealing surface, and power operated means connected to the permanent magnet for retraction thereof against the bias of the spring means to the standby condition.

5. The combination or claim 4 wherein said power operated means includes a source of vacuum pressure, a piston assembly to which said source is connected, and passage means connecting the piston assembly to the suction chamber means for simultaneously rendering the suction chamber means effective and the permanent magnet ineffective.

6. The combination of claim 5 including means embedded in the suction cup for establishing a magnetic flux path between the electromagnetic means and the sheet material through said sealing surface.

7. The combination of claim 1 wherein said movable mechanical means comprises spring means biasing the permanent magnet to an extended contact position within the suction cup projecting beyond the sealing surface, and power operated means connected to the permanent magnet for retraction thereof against the bias of the spring means to the standby condition.

8. The combination of claim 7 wherein said power operated means includes a source of vacuum pressure, a piston assembly to which said source is connected, and passage means connecting the piston assembly to the suction chamber means for simultaneously rendering the suction chamber means effective and the permanent magnet ineffective.

9. The combination oif claim 2 including means embedded in the suction cup for establishing a magnetic flux path between the electromagnetic means and the sheet material through said sealing surface.

10. The combination of claim 1 including means embedded in the suction cup for establishing a magnetic flux path between the permanent magnet and the sheet material through said sealing surface.

11. The combination of claim 10 wherein said permanent magnet includes relatively movable sections, said movable mechanical means being connected to at least one of said sections for displacement thereof to a position placing the permanent magnet in said standby condition.

12. A lifting device for sheet material, comprising a body, a suction cup fixedly mounted on the body having flexible means engageable with the sheet material for holding the same on the body under a predetermined suction pressure, a permanent magnet having at least one relatively movable section, means mounting said permanent magnet on the body for exerting a magnetic holding force on the sheet material while in engagement with the flexible means of the suction cup, and means connected to the permanent magnet for varying the magnetic holding force applied to the sheet material in response to displacement of the movable section relative to the body.

13. The combination of claim 12 including selectively operated means connected to the body for exerting a variable holding force on the sheet material while in engagement with the suction cup to prevent distortion of the sheet material.

14. The combination of claim 13 wherein said magnetic holding force of the permanent magnet is varied between a maximum standby value and an ineffective minimum value.

15. The combination of claim 12 wherein said magnetic holding force of the permanent magnet is varied between a maximum standby value and an ineffective minimum value.

* * * * *